United States Patent [19]

Yoshinaga

[11] Patent Number: 5,071,342

[45] **Date of Patent: * Dec. 10, 1991**

[54] BURNER DEVICE

[75] Inventor: Sadao Yoshinaga, Ichikawa, Japan

[73] Assignee: Prince Industrial Development Company, Ltd., Tokyo, Japan

[ * ] Notice: The portion of the term of this patent subsequent to Jul. 3, 2007 has been disclaimed.

[21] Appl. No.: 548,382

[22] Filed: Jul. 3, 1990

Related U.S. Application Data

[60] Continuation of Ser. No. 272,102, Nov. 16, 1988, Pat. No. 4,938,686, which is a division of Ser. No. 894,797, Aug. 8, 1986, Pat. No. 4,804,324.

[51] Int. Cl.[5] ..... F23Q 2/16

[52] U.S. Cl. ..... 431/264; 431/255; 431/344; 431/345

[58] Field of Search ..... 431/255, 264, 265, 266, 431/344, 345

[56] References Cited

U.S. PATENT DOCUMENTS

| | | | |
|---|---|---|---|
| 1,182,288 | 5/1916 | Mack . | |
| 2,096,945 | 10/1937 | Van Law | 431/264 X |
| 2,836,232 | 5/1958 | Horstmann . | |
| 2,862,993 | 12/1958 | Schmidt . | |
| 2,942,897 | 6/1960 | Eason . | |
| 3,070,153 | 12/1962 | Flynn | 431/266 |
| 3,263,729 | 8/1966 | Fetter et al. | 431/266 |
| 3,301,306 | 1/1967 | Finley et al. . | |
| 3,431,058 | 3/1969 | Hufferd | 431/264 |
| 3,620,660 | 11/1971 | Laurent | 431/255 |
| 3,849,058 | 11/1974 | Rankow | 431/264 |
| 3,994,674 | 11/1976 | Baumann et al. | 431/354 |
| 4,224,019 | 9/1980 | Dilmore | 431/328 |
| 4,315,732 | 2/1982 | Rowbottam et al. | 431/344 |
| 4,526,532 | 7/1985 | Nelson | 431/255 |
| 4,538,984 | 9/1985 | Nakagawa | 431/255 |
| 4,545,759 | 10/1985 | Giles et al. | 431/344 |
| 4,938,686 | 7/1990 | Yoshinaga | 431/344 X |

FOREIGN PATENT DOCUMENTS

| | | |
|---|---|---|
| 2824548 | 12/1979 | Fed. Rep. of Germany . |
| 2269683 | 1/1976 | France . |
| 0031211 | 2/1983 | Japan . |
| 1456632 | 11/1976 | United Kingdom . |

*Primary Examiner*—Carl D. Price

*Attorney, Agent, or Firm*—Weingarten, Schurgin, Gagnebin & Hayes

[57] ABSTRACT

In this invention, two connecting devices are provided in a burner device to accommodate liquefied gas cylinders/fuel tanks having different mounting cap configurations. The invention also includes a piezoelectric ignition device as part of the burner device for igniting gas provided by the liquefied gas cylinder/fuel tank.

1 Claim, 4 Drawing Sheets

BURNER DEVICE

RELATED APPLICATION

This application is a continuation of Application Ser. No. 07/272,102 filed Nov. 16, 1988 now U.S. Pat. No. 4,938,686, which is a divisional of Application Ser. No. 06/894,797 filed Aug. 8, 1986 now U.S. Pat. No. 4,804,324.

FIELD OF THE INVENTION

This invention relates to a compact burner device for use in welding, cutting and other types of metalworking.

BACKGROUND OF THE INVENTION

Conventional burner devices include a connecting member which engages the liquefied gas cylinder/fuel tank by pinching the periphery of the liquiefied gas cylinder/fuel tank. This type of connecting member is limited to use with particular liquefied gas cylinders/fuel tanks and is generally not usable with commercially available portable liquefied gas cylinders.

SUMMARY OF THE INVENTION

This invention was devised to solve the problem described above. The object of this invention is to provide a burner device having two connecting means which permit the burner device to use liquefied gas cylinders/fuel tanks having a variety of mounting cap configurations. One or both connecting means may be used to connect the burner device with a liquefied gas cylinder and when both connecting means are used, a more secure connection is ensure.

The burner device of the present invention comprises a burner body having a nozzle device, a valve device and a n integrally formed cylindrical connecting portion. A connecting member is installed in the connecting portion and includes a lower portion protruding outwardly from the connecting portion. The lower portion forms an intake opening in which is disposed an outwardly protruding injection stem.

A cap-shaped holder is disposed about the periphery of the lower portion and includes a circumferential wall having an inwardly depending protrusion. A rotatable clamping member is threaded on the outer surface of the connecting member to be disposed outwardly of the holder.

The configuration of the burner device according to the present invention includes a piezo-electric igniter for igniting a gas flowing therethrough.

The igniter of this invention is a piezoelectric ignition device which is disposed in a casing formed on one side of the burner body. The piezoelectric ignition device is configured to ignite the discharged gas at the exit end of the nozzle device.

The invention will be described in detail according to embodiments shown in drawings.

BRIEF DESCRIPTION OF THE DRAWINGS

Drawings indicate embodiments of a burner device according to the present invention.

DETAILED DESCRIPTION OF THE INVENTION

Figure 1:
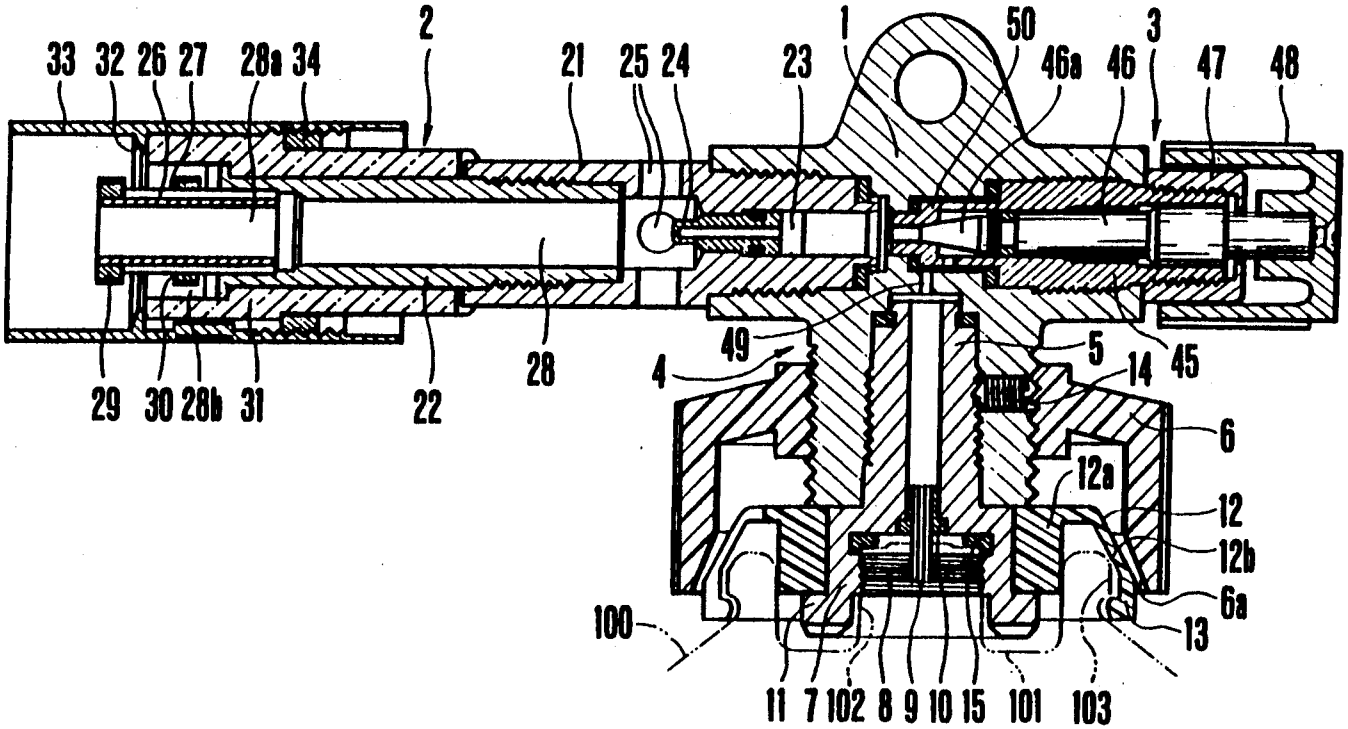
FIG. 1 is a cross sectional view of a burner device according to the present invention.

The drawings illustrate a burner device according to the present invention for use in combination with a liquefied gas cylinder or tank 100. The liquefied gas cylinder 100 includes a mounting cap 101 having a periphery 103 and a closed, protruding central portion 102.

The burner device 200 includes a body 1 having a nozzle device 2 and a valve device 3 for controlling gas flow threaded thereinto. A cylindrical connecting portion 4 is integrally formed as part of the body 1, as shown in FIG. 1.

Threads are provided on the inner and outer surfaces of the connecting portion 4. A connecting member 5 having an externally threaded end is threaded into the inner threaded surface of the connecting portion 4. A cap-shaped clamping member 6 having an internally threaded surface is threaded to the outer threaded surface of the connecting portion 4.

The connecting member 5 is a hollow body having a lower portion 7 protruding outwardly from the connecting portion 4 which forms an intake opening **7*a* having a larger diameter than the connecting portion 4. The intake opening 7*a* has a threaded surface 8. The inner diameter of the intake opening 7*a* is slightly larger than the outer diameter of the closed, protruding central portion 102 of the liquefied gas cylinder 100. An injection stem 9 engaged in a sleeve 10 is mounted in the hollow body of the connecting member 5 to protrude through the closed, protruding central portion 102 of the liquefied gas cylinder 100**.

The external end of the lower portion 7 is formed as a flange 11. A cap-shaped holder 12 having a mid-portion **12*a* and a peripheral wall 12*b* is combined with the connecting portion 4 by fitting the mid-portion 12*a* between the flange 11 and the lower end of the connecting member 5. The mid-portion 12*a* is block shaped in cross-section and has a diameter approximately equal to the inner diameter of the periphery 103 of the mounting cap 101**.

An inwardly-extending protrusion 13 is integrally formed at the external end of the periphery wall **12*b*. The protrusion 13 engages the periphery 103 of the liquefied gas cylinder 100. The inner diameter of the periphery wall 12*b*** may be decreased by providing a plurality of divided grooves on the inner surface thereof.

The clamping member 6 is sized to contain the cap-shaped holder 12 and is provided with a tapered surface **6*a* as shown in FIG. 1. The tapered surface 6*a* presses against the periphery wall 12*b* to urge the protrusion 13 into engagement with the periphery 103 of the liquefied gas cylinder 100**.

A stop screw 14 is provided as shown in FIG. 1. A packing material 15 is also provided in the intake opening **7*a* as shown in FIG. 1**.

The nozzle device 2 includes a nozzle base pipe 21 threaded into the burner body 1 and a nozzle tube 22 threaded into the nozzle base pipe 21. A spray nozzle 24 and a filter 23 are disposed in the nozzle pipe 21. Air intake holes 25 are formed through the nozzle base pipe 21 downstream from the filter 23.

A cylindrical nozzle head 26 which forms a burner is provided at the exit end of the nozzle tube 22. A plurality of spline grooves 27 are formed about the periphery of the nozzle head 26. One end of the nozzle head 26 is inserted into opening at the exit end of the nozzle tube 22. A flow passage 28 through the nozzle tube 22 is thus divided by the nozzle head 26 into two passages, a main passage 28*a* and a corresponding plurality of sub-passages 28*b*.

Ring members 29, 30 are inserted at the exit end of the nozzle head 26 about the periphery thereof, respectively. The ring member 29 is fixed and serves as an electrode while the ring member 30 is movable and operates as a resistant body to control the flow of gas.

Figure 5:
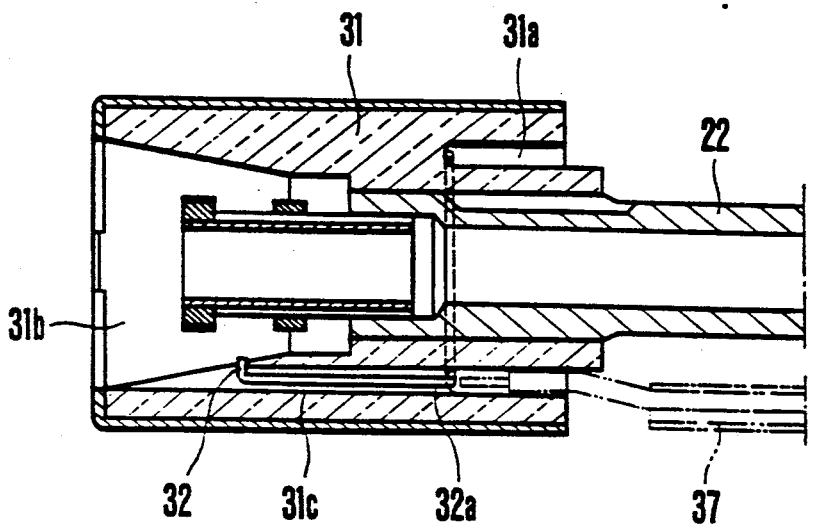
FIG. 5 is a cross sectional view of another embodiment of a nozzle device.

An insulating member 31 is secured to the periphery of nozzle tube 22 as shown in the embodiments of FIGS. 1 and 5. The insulating cylinder 31 surrounds the sub-passage 28*b* and operates as an electrode stand. The insulating cylinder 31 is formed from a ceramic material and includes a step portion and a groove.

Figure 2:
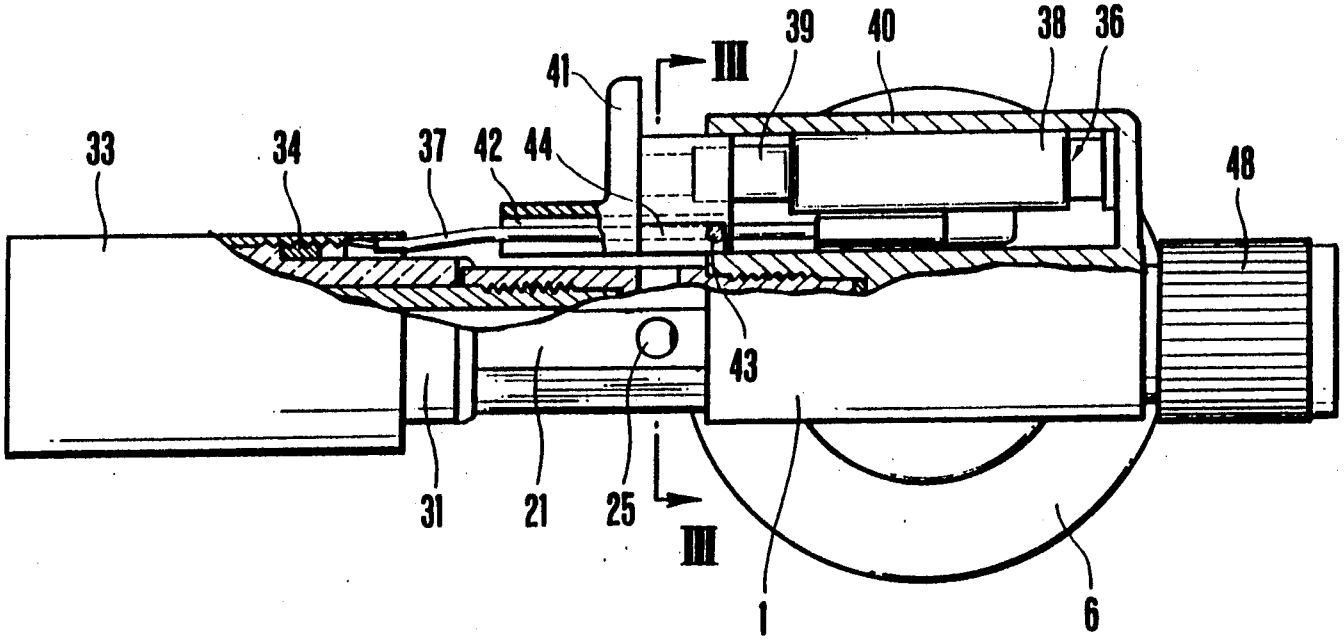
FIG. 2 is a partial sectional view of the burner device of FIG. 1.
Figure 4:
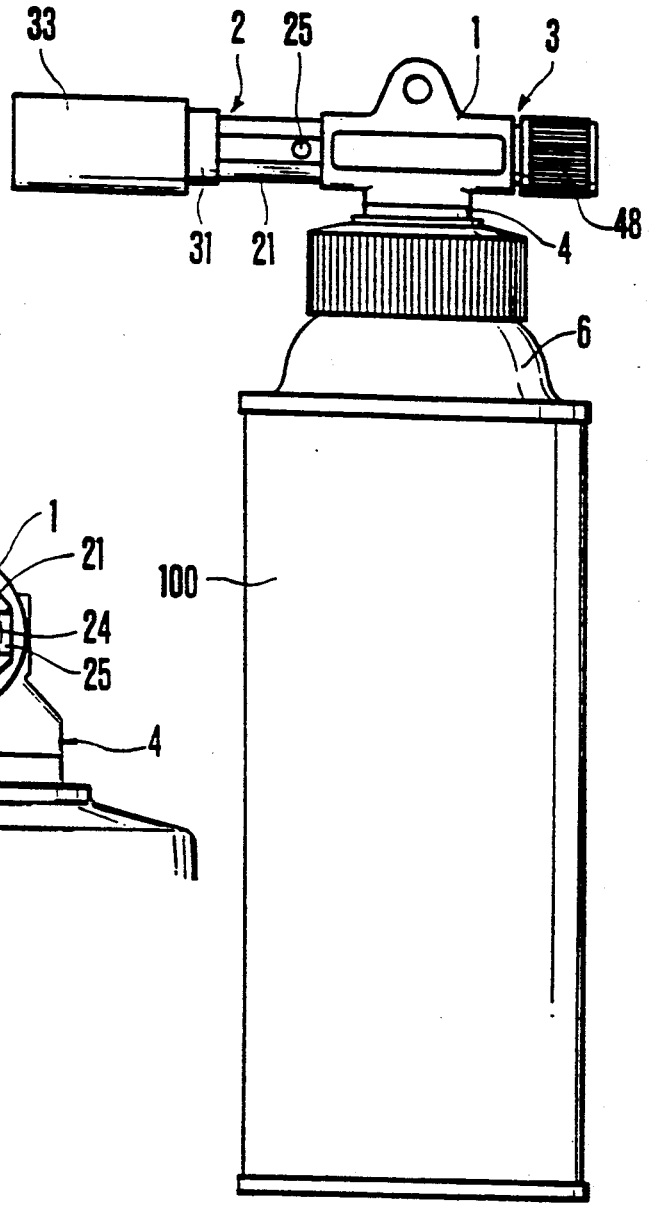
FIG. 4 is a plan view of the burner device secured to a liquefied gas bomb.

A burner cover 33 is disposed about the insulating cylinder 21 as shown. Referring to FIG. 1, a nut 34 is inserted in the groove between the burner cover 33 and the insulating cylinder 31 to act as a rotational stop and retainer for the burner cover 33. The burner cover 33 of FIG. 1 also includes a protruding discharge electrode 32 which acts as a latch member by engaging the step portion of the internal cylinder 31. The burner cover 33 is connected to a lead wire 37 of a piezoelectric ignition device 36 provided on the body 1 as shown in FIG. 2.

The connection between the lead wire 37 and the burner cover 33 can be easily achieved by inserting the end portion of the lead wire 37 into the clearance between the insulating cylinder 31 and the burner cover 33. The end portion of the lead wire 37 is then connected to the burner cover 33.

In the embodiment shown in FIG. 5 the insulating cylinder 31 includes a coaxially formed recess 31*a*. The insulating cylinder 31 of FIG. 5 also includes a hole 31*c* extending into a recess 31*a* and forming an opening 31*b* at the external end of the insulating cylinder 31.

A metal wire 32*a*, one end of which acts as the electrode 32, is inserted into the recess 31*a* and the hold 31*c*. The end portion of the lead wire 37 is inserted into the recess 31*a* to engage the metal wire 32*a*.

As shown in FIG. 2, the piezoelectric ignition device 36 comprises a fixed member 38 containing a piezoelectric element and an impact spring and a movable member 39 inserted into said fixed member 38. The movable member 39 is urged outwardly by the impact spring in a manner similar to piezoelectric ignition devices used in gas lighters or the like. The piezoelectric ignition device 36 is housed in a casing 40 integrally formed on the body 1.

Figure 3:
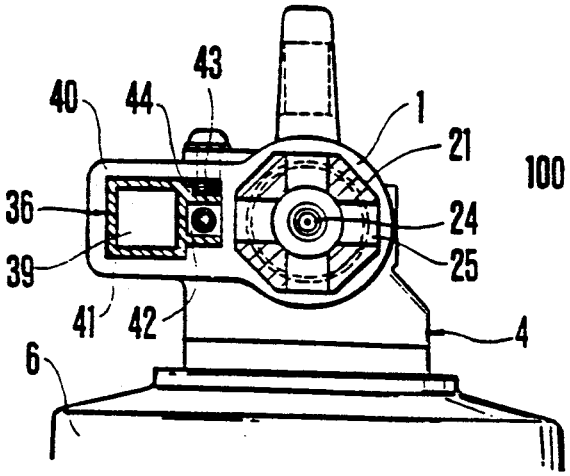
FIG. 3 is a cross sectional view of the burner device of FIG. 2 taken along line III—III.

Referring to FIG. 3, the piezoelectric ignition device 36 includes an operating device 41 which slides along the inside of the casing 40. The operating device 41 includes a housing groove 42 for the lead wire 37 and a surface groove 44. A retaining screw 43 is disposed in the surface groove 44 to prevent the operating device 41 from sliding out of the casing 40 in the direction of motion of the movable member 39.

Figure 6:
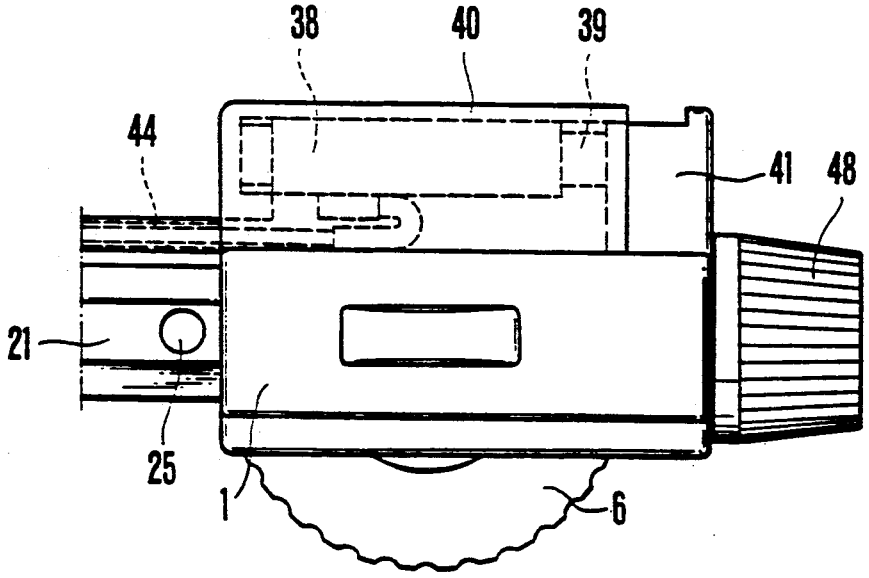
FIG. 6 is a partial plan view showing another embodiment of a piezo-electric ignition device.
Figure 1:
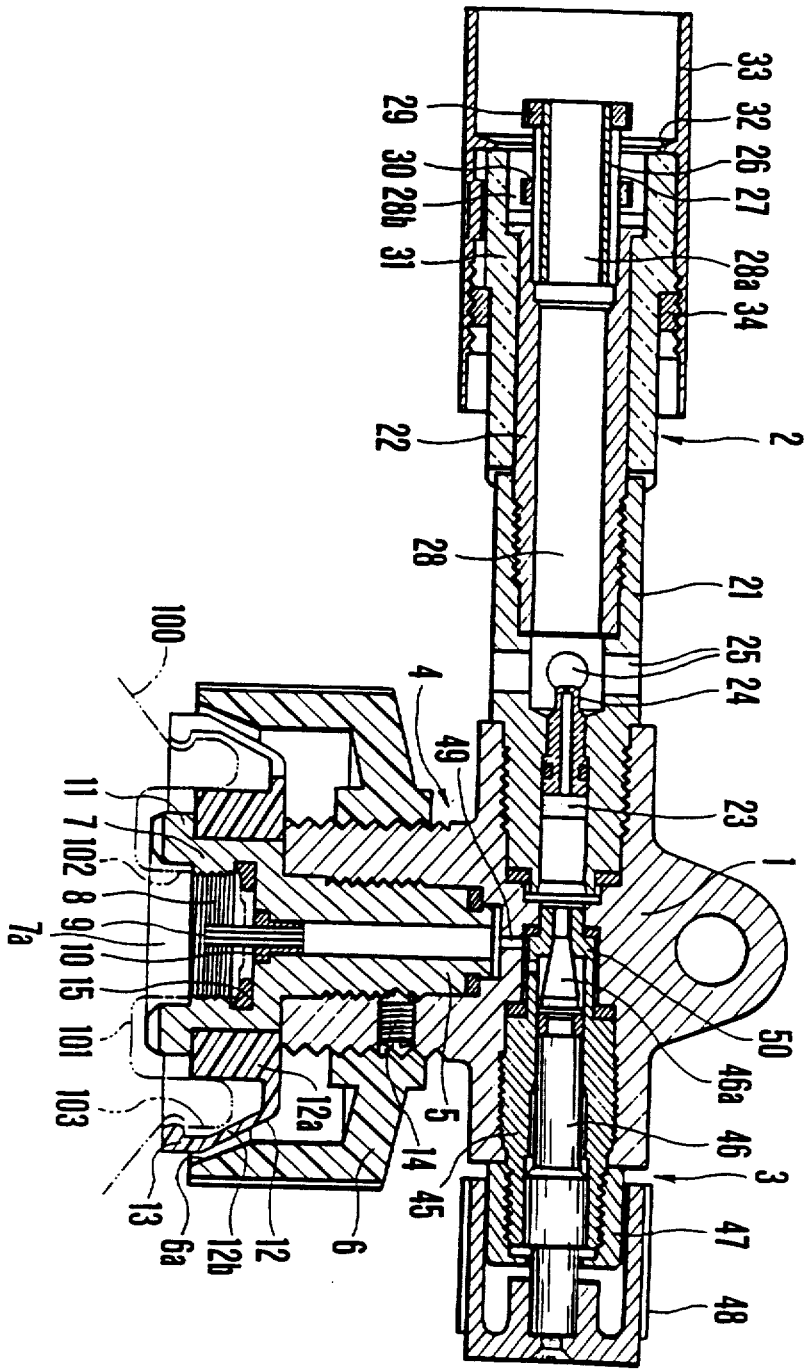

FIG. 6 illustrates an embodiment wherein the piezoelectric ignition device 36 is contained in the casing 40 with the fixed member 38, the movable member 39 and the operating device 41 in reverse orientation from the embodiment of FIG. 3. Since the operating device 41 protrudes towards the valve device 3, the housing groove to contain the lead wire 37 is unnecessary. Further, since the operating device 41 contacts an end face of a valve operating device as described hereafter, the retaining screw is also unnecessary.

As shown in FIG. 1, the valve device 3 includes a cylinder 45 into the body 1 and a valve operating device 48. The valve operating device 48 includes a needle valve 46 having an end 46*a* disposed in the cylinder 45 and a stopper member 47, integrally formed with the needle valve 46, threaded onto the cylinder 45 as shown.

A valve seat 50 is formed at the internal end of the cylinder 45. The valve seat 50 communicates with a gas passage 49 formed in the body 1 and the nozzle device 2.

To connect the burner device to the liquefied gas cylinder 100, the lower portion 7 and mid-portion 12*a* are inserted within the periphery 103 by rotating the clamping member 6 towards the liquefied gas cylinder 100. This movement causes the peripheral wall 12*b* to be pressed against the periphery 103 such that the protrusion 13 engages the periphery 103.

If the liquefied gas cylinder 100 has an externally threaded closed, protruding central portion 102, the central portion 102 is first threaded into the threaded surface 8 of the intake opening 7*a*. The holder 12 is then engaged with the clamping member 6 by rotating the clamping member 6 as described above.

By this connection, the closed, protruding central portion 102 of the cylinder 100 is pushed open by the injection stem 9. With the needle valve 46 in the open position, gas flows out of the liquefied gas cylinder 100 and through the connecting member 5, passage 49, valve seat 50, filter 23 and spray nozzle 24 into the passage 28 in the nozzle pipe 21. Intake air from the air intake holes 25 is mixed with the gas flow and the mixture flows outwardly through the main passage 28*a* and the sub-passages 28*b*.

Operation of the piezoelectric ignition device 36 generates a discharge spark between the discharge electrode 32 and the ring member 29 which ignites the mixture flowing through the sub-passages 28*b*.

Accordingly, the configuration of the burner device according to the present invention includes two means for connecting the burner device to a liquefied gas cylinder. The first means is the threaded surface of the intake opening and the second means is the cap-shaped member in combination with the cap-shaped clamping member as described hereinabove. Since either or both means may be used to connect a liquefied gas cylinder to the burner device, the burner device of the present invention can advantageously be used with commercially available gas cylinders.

Since the present invention includes a piezoelectric ignition device, there is no necessity to provide another ignition device. Furthermore, since ignition is accomplished by igniting the small gas flow through the sub-passage which subsequently ignites the large gas flow of the main passage, ignition is reliably achieved even with limited ignition energy. And since ignition occurs at the external end of the cylindrical nozzle head, there is no danger of electrical shock during ignition.

What is claimed is:

1. A burner device comprising:

a burner body coupled to a fuel source at a lower side thereof;

a nozzle device threaded into a front portion of said burner body;

a rear portion of said burner body having a valve device therein; and a piezoelectric ignition device;

said nozzle device including a nozzle tube having a flow passage formed therethrough and having a burner at an exit end of said nozzle tube;

said burner device including a pipe-shaped nozzle head, said pipe-shaped nozzle head including separately a main passage interior to a sub-passage, said main passage and said sub-passage fluidly coupled to said flow passage of said nozzle tube, said main passage and said sub-passage providing a flow of fuel-air mixture therethrough;

a burner cover surrounding said burner and having an exit opening, said burner located within said burner cover and spaced inwardly of said exit opening of said burner cover;

an insulating member mounted within said burner cover inwardly of said exit opening of said burner cover, and serving as an electrode stand proximate said sub-passage; and a discharge electrode mounted on said insulating member inwardly of said exit opening and proximate said sub-passage, said discharge electrode connected with a lead wire to said piezoelectric ignition device for igniting the fuel-air mixture of said sub-passage.

* * * * *

UNITED STATES PATENT AND TRADEMARK OFFICE

CERTIFICATE OF CORRECTION

PATENT NO. : 5,071,342

DATED : December 10, 1991

INVENTOR(S) : Sadao Yoshinaga

It is certified that error appears in the above-indentified patent and that said Letters Patent is hereby corrected as shown below:

The title page, should be deleted to be replaced with the attached title page.

The drawing sheet, consisting of Fig. 1, should be deleted to be replaced with the drawing sheet, consisting of Fig. 1, as shown on the attached page.

United States Patent [19]

Yoshinaga

[11] Patent Number: 5,071,342

[45] **Date of Patent: * Dec. 10, 1991**

[54] BURNER DEVICE

[75] Inventor: Sadao Yoshinaga, Ichikawa, Japan

[73] Assignee: Prince Industrial Development Company, Ltd., Tokyo, Japan

[ * ] Notice: The portion of the term of this patent subsequent to Jul. 3, 2007 has been disclaimed.

[21] Appl. No.: 548,382

[22] Filed: Jul. 3, 1990

Related U.S. Application Data

[60] Continuation of Ser. No. 272,102, Nov. 16, 1988, Pat. No. 4,938,686, which is a division of Ser. No. 894,797, Aug. 8, 1986, Pat. No. 4,804,324.

[51] Int. Cl.[5] ..... F23Q 2/16

[52] U.S. Cl. ..... 431/264; 431/255; 431/344; 431/345

[58] Field of Search ..... 431/255, 264, 265, 266, 431/344, 345

[56] References Cited

U.S. PATENT DOCUMENTS

| | | | |
|---|---|---|---|
| 1,182,288 | 5/1916 | Mack . | |
| 2,096,945 | 10/1937 | Van Law | 431/264 X |
| 2,836,232 | 5/1958 | Horstmann . | |
| 2,862,993 | 12/1958 | Schmidt . | |
| 2,942,897 | 6/1960 | Eason . | |
| 3,070,153 | 12/1962 | Flynn | 431/266 |
| 3,263,729 | 8/1966 | Fetter et al. | 431/266 |
| 3,301,306 | 1/1967 | Finley et al. . | |
| 3,431,058 | 3/1969 | Hufferd | 431/264 |
| 3,620,660 | 11/1971 | Laurent | 431/255 |
| 3,849,058 | 11/1974 | Rankow | 431/264 |
| 3,994,674 | 11/1976 | Baumann et al. | 431/354 |
| 4,224,019 | 9/1980 | Dilmore | 431/328 |
| 4,315,732 | 2/1982 | Rowbottam et al. | 431/344 |
| 4,526,532 | 7/1985 | Nelson | 431/255 |
| 4,538,984 | 9/1985 | Nakagawa | 431/255 |
| 4,545,759 | 10/1985 | Giles et al. | 431/344 |
| 4,938,686 | 7/1990 | Yoshinaga | 431/344 X |

FOREIGN PATENT DOCUMENTS

| | | |
|---|---|---|
| 2824548 | 12/1979 | Fed. Rep. of Germany . |
| 2269683 | 1/1976 | France . |
| 0031211 | 2/1983 | Japan . |
| 1456632 | 11/1976 | United Kingdom . |

*Primary Examiner*—Carl D. Price

*Attorney, Agent, or Firm*—Weingarten, Schurgin, Gagnebin & Hayes

[57] ABSTRACT

In this invention, two connecting devices are provided in a burner device to accommodate liquefied gas cylinders/fuel tanks having different mounting cap configurations. The invention also includes a piezoelectric ignition device as part of the burner device for igniting gas provided by the liquefied gas cylinder/fuel tank.

1 Claim, 4 Drawing Sheets

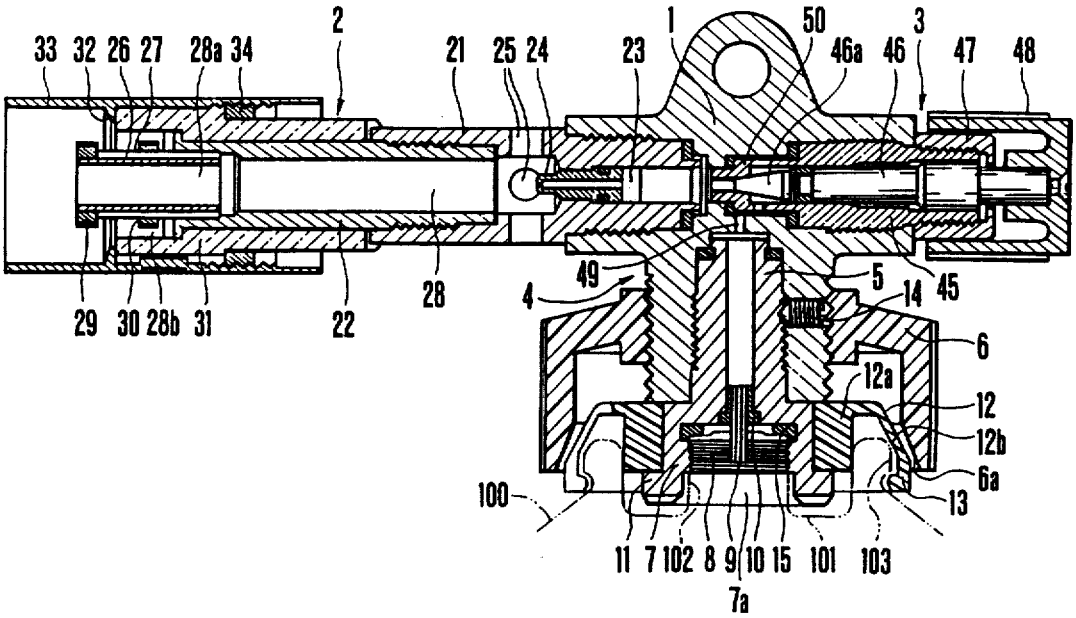

UNITED STATES PATENT AND TRADEMARK OFFICE

CERTIFICATE OF CORRECTION

PATENT NO. : 5,071,342

DATED : December 10, 1991

INVENTOR(S) : Sadao Yoshinaga

It is certified that error appears in the above-indentified patent and that said Letters Patent is hereby corrected as shown below:

Column 1, line 4, the heading "RELATED APPLICATION" should be centered.

Column 1, line 34, "ensure" should read --ensured--.

Column 1, line 37, "and a n integrally formed" should read --and an integrally formed--.

Column 1, line 50, "piezo-electric" should read --piezoelectric--.

Column 2, line 6, "piezo-electric" should read --piezoelectric.

Signed and Sealed this

Third Day of August, 1993

*Attest:*

Michael K. Kirk

MICHAEL K. KIRK

*Attesting Officer*

*Acting Commissioner of Patents and Trademarks*